US006883899B2

(12) United States Patent
Pannu et al.

(10) Patent No.: US 6,883,899 B2
(45) Date of Patent: Apr. 26, 2005

(54) DROPLET GENERATOR FOR A CONTINUOUS STREAM INK JET PRINT HEAD

(75) Inventors: Sukbir Singh Pannu, Grantchester (GB); Nigel Edward Sherman, Bury St. Edmunda (GB)

(73) Assignee: Videojet Technologies, Inc., Wood Dale, IL (US)

( * ) Notice: Subject to any disclaimer, the term of this patent is extended or adjusted under 35 U.S.C. 154(b) by 0 days.

(21) Appl. No.: 10/399,884

(22) PCT Filed: Oct. 22, 2001

(86) PCT No.: PCT/GB01/04677

§ 371 (c)(1),
(2), (4) Date: Sep. 5, 2003

(87) PCT Pub. No.: WO02/34526

PCT Pub. Date: May 2, 2002

(65) Prior Publication Data

US 2004/0046839 A1 Mar. 11, 2004

(30) Foreign Application Priority Data

Oct. 24, 2000 (GB) ..... 0026014

(51) Int. Cl.[7] ..... B41J 2/04
(52) U.S. Cl. ..... 347/54
(58) Field of Search ..... 347/77, 76, 54, 347/55, 151, 120, 141, 154, 103, 123, 111, 159, 127, 128, 131, 125, 68–72, 50, 40

(56) References Cited

U.S. PATENT DOCUMENTS

| | | | | |
|---|---|---|---|---|
| 4,095,232 | A | 6/1978 | Cha | |
| 4,587,528 | A | 5/1986 | Beaudet | |
| 5,502,473 | A | 3/1996 | East et al. | |
| 2003/0156169 | A1 * | 8/2003 | Martin et al. | 347/77 |

FOREIGN PATENT DOCUMENTS

| | | |
|---|---|---|
| EP | 0 709 194 A1 | 10/1995 |
| JP | 63172655 | 7/1988 |
| JP | 63172656 | 7/1988 |
| JP | 63179754 | 7/1988 |
| JP | 63179755 | 7/1988 |
| JP | 11156638 | 6/1999 |
| WO | WO 98/51503 | 11/1998 |

* cited by examiner

*Primary Examiner*—Raquel Yvette Gordon
(74) *Attorney, Agent, or Firm*—Kirschstein, et al.

(57) ABSTRACT

A droplet generator for a continuous stream inkjet print head has an elongate cavity for containing the ink and nozzle orifices in a wall of the cavity for passing the ink from the cavity to form jets. The nozzle orifices extend along the length of the cavity. An actuator is disposed so as to address the face of the cavity opposite the wall to vibrate the ink in the cavity such that each jet breaks up into ink droplets at substantially the same predetermined distance from the wall. The actuator has a plurality of constituent sub-actuators each capable of independent vibration. The combined coverage of the face of the cavity by the sub-actuators is such that the jet break up can be achieved without resonance of the cavity in its dimension from the wall to the face.

11 Claims, 5 Drawing Sheets

DROPLET GENERATOR FOR A CONTINUOUS STREAM INK JET PRINT HEAD

BACKGROUND OF THE INVENTION

This invention relates to a droplet generator for a continuous stream ink jet print head.

More particularly the invention relates to such a generator comprising: an elongate cavity for containing the ink; nozzle orifices in a wall of the cavity for passing ink from the cavity to form jets, the nozzle orifices extending along the length of the cavity; and an actuator disposed on the opposite side of the cavity to the nozzle orifice wall for vibrating the ink in the cavity such that each jet breaks up into ink droplets at substantially the same predetermined distance from the wall, i.e. such that there is uniform jet break up.

Droplet generators of the above kind are disclosed in U.S. Pat. No. 4,587,528 and U.S. Pat. No. 5,502,473. However, in order to achieve uniform jet break up, these generators must be operated at a frequency at which the ink cavity is resonant in its vertical dimension, i.e. from the nozzle orifices to the actuator. In other words, it is necessary that at operating frequency an integer number of half wavelengths fit precisely into this dimension. Consequently, a very high accuracy is required of the physical dimensions of the structural components of the generator. Further, very little stray is permitted in operating parameters of the generator such as ink composition and temperature.

WO-A-98/51503 also discloses a droplet generator of the above kind, which generator is able to achieve the required uniform jet break up without resonance of the ink cavity in its vertical dimension. This is done by arranging for the actuator to address the full or complete area of the face of the ink cavity opposite the nozzle orifice wall. The actuator addresses the ink in a piston-like manner, i.e. all points across the actuator face that addresses the ink vibrate vertically in phase and with the same amplitude. A drawback with this droplet generator is that it is difficult to achieve the required precise piston-like motion of the actuator at all points along the actuator's length. This problem increases the longer the ink cavity (typically 50 mm and above) and the higher the frequency of operation (typically 100 kHz and above).

SUMMARY OF THE INVENTION

According to the present invention there is provided a droplet generator for a continuous stream ink jet print head comprising: an elongate cavity for containing the ink; nozzle orifices in a wall of said cavity for passing ink from the cavity to form jets, said nozzle orifices extending along the length of said cavity; and actuator means disposed so as to address the face of said cavity opposite said wall to vibrate the ink in the cavity such that each said jet breaks up into ink droplets at substantially the same predetermined distance from said wall, said actuator means comprising a plurality of constituent sub-actuators each capable of independent vibration, the combined coverage of said face of the cavity by said sub-actuators being such that the said jet break up can be achieved without resonance of said cavity in its dimension from said wall to said face.

Preferably, each said sub-actuator includes a holding-part whereby it is held by said generator, the dimension of said holding-part in a direction along the cavity being less than the dimension in the same direction of an ink addressing face of the sub-actuator.

BRIEF DESCRIPTION OF THE DRAWINGS

A droplet generator in accordance with the present invention will now be described, by way of example, with reference to the accompanying drawings, in which.

DETAILED DESCRIPTION OF THE PREFERRED EMBODIMENTS

Figure 1:
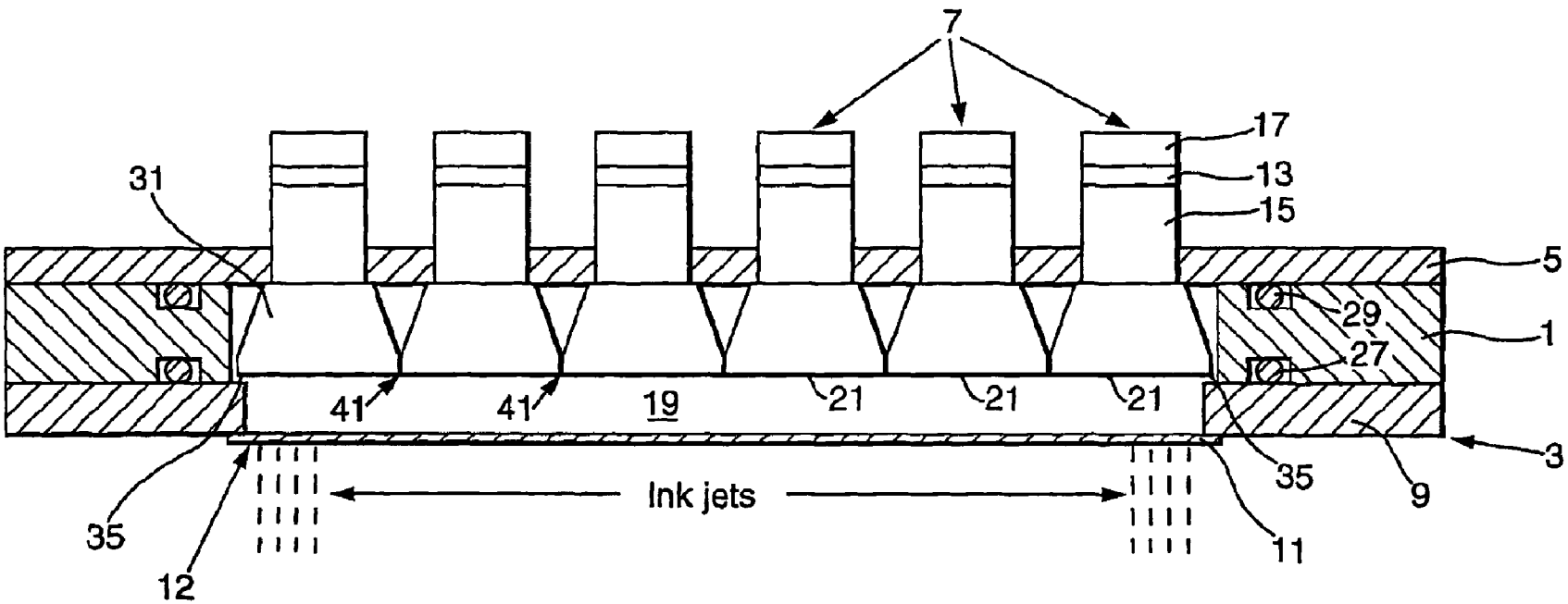
FIGS. 1 and 2 are side and end views respectively of the generator.
Figure 2:
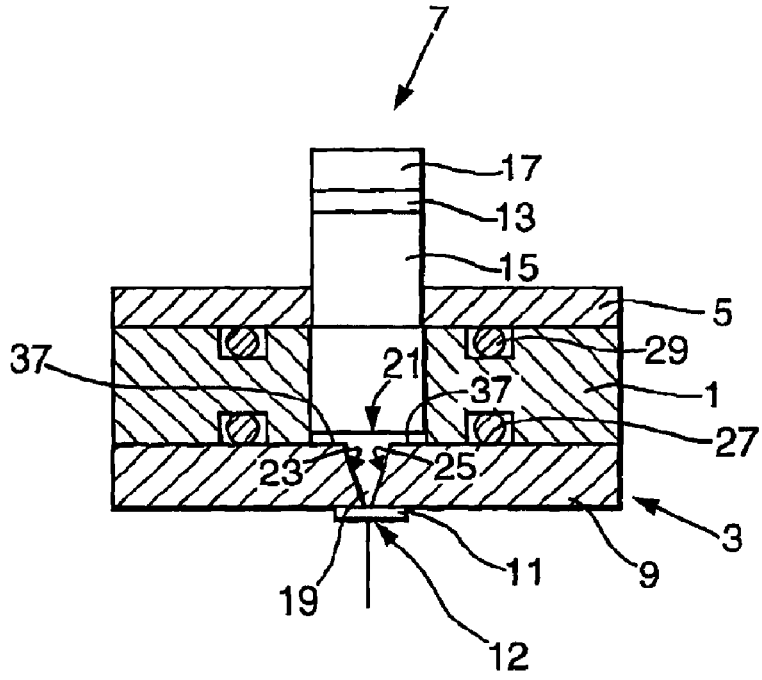

Referring to FIGS. 1 to 4, the generator comprises a polyetheretherketone manifold 1, a nozzle carrier 3 secured to the underneath of manifold 1, a top plate 5, and, held by plate 5, an actuator in the form of six sub-actuators 7. Nozzle carrier 3 comprises a stainless steel element 9 defining therein a 'V' cross-section channel, and, bonded to element 9, a stainless steel foil sheet 11. Sheet 11 contains a line of nozzle orifices 12, and is so bonded to element 9 that this line runs along the length of the open apex of the 'V' cross-section channel of element 9. Each sub-actuator 7 comprises a piezoelectric driver 13, a stainless steel head 15 below driver 13, and a brass tuning mass 17.

An elongate ink cavity 19 is defined by the lower faces 21 of sub-actuators 7, and the interior faces 23, 25 of element 9 which define the 'V' cross-section channel of element 9. 'O' rings 27, 29 provide an ink seal respectively between element 9 and manifold 1, and between manifold 1 and top plate 5. Channels (not shown) are provided in manifold 1 to communicate with cavity 19 to supply ink under pressure thereto and bleed air/ink therefrom.

A lower part 31 of the head 15 of each sub-actuator 7, forms a shoulder 33 with the remainder of the sub-actuator, and this lower part, as it approaches ink cavity 19, flares outwardly to each side along the length of the cavity. This part 31 of each sub-actuator 7 will be referred to as the foot of the sub-actuator. The ink in cavity 19 is addressed by the lower face 21 of the foot 31 of each sub-actuator. Each lower face 21 comprises an elongate rectangle.

In the droplet generator, sub-actuators 7 are disposed so that their rectangular lower faces 21 lie in the same plane, in line, along cavity 19, the longer sides of each face extending along the cavity, the shorter sides being closely adjacent and parallel. Each end of cavity 19 is overlapped by the sub-actuator 7 disposed thereat. This overlap is referenced 35. Sub-actuators 7 overlap the sides of cavity 19 along its entire length. This overlap is referenced 37.

The remainder of each sub-actuator 7 above foot 31 is in the form of a cylinder 39. Each cylinder 39 is push fitted into a respective hole in top plate 5, which hole has a diameter slightly less than that of the cylinder. Plate 5 is made of a compliant material so as to form an ink tight seal around each cylinder 39. Such sealing obviates the need for 'O' rings or gaskets, the use of which would be relatively complex given the number of sub-actuators and the tight space requirement. Plate 5 should not be so compliant that it distorts under the pressure applied to ink cavity 19. Further, plate 5 should hold sub-actuators 7 sufficiently securely that they are not pushed out under ink cavity pressure. Plate 5 is suitably made of a plastics material such as polyetheretherketone or Delrin. When fitted, the shoulder 33 of each sub-actuator abuts against the bottom face of plate 5. Such abutment further prevents the pushing out of sub-actuators 7 under ink cavity pressure. Such abutment may be dispensed with, i.e. cylinder 39 may extend lower than the bottom face of plate 5.

The length of the lower face 21 of each sub-actuator 7 is significantly greater than the diameter of each cylinder 39. This enables only a narrow gap 41 to be present between faces 21, whilst at the same time providing sufficient separation of the cylinders 39 to enable proper individual securing of sub-actuators 7 in top plate 5. In this regard, if the holes in plate 5 are too close together, the distortion in plate 5 caused by the push fitting will be communicated from one hole to the next causing failure of the push fit seals. Further, if the holes are too close together, in operation of the generator, too much vibration will be communicated from one sub-actuator to the next.

At the frequency of operation of the generator, each sub-actuator 7 has a vertical thickness resonance at which all points across its lower face 21 vibrate vertically in phase and with the same amplitude, i.e. At which lower face 21 is driven in contact with the ink in cavity 19 in piston-like manner. Each sub-actuator 7 is held by top plate 5 at a position along its length corresponding or close to a stationary node in its resonant vibration. Sub-actuators 7 are driven in synchronism so that they behave collectively as a single piston-like actuator having a lower face that extends the full length and width of ink cavity 19, i.e. To cavity 19 sub-actuators 7 appear as a single piston actuator extending its fill length and width.

Cavity 19 is shaped so as to provide a steady and essentially unidirectional flow of ink to nozzle orifices 12. The reducing surface area in the direction of wave travel (i.e. From the lower faces 21 of sub-actuators 7 to nozzle orifices 12) causes an increased acoustic pressure at the apex of the 'V' cross-section channel as compared to that at lower faces 21.

The advantage of the simulation by sub-actuators 7 of a single piston actuator covering the full cavity, is that the cavity need not be resonant in its vertical dimension at operating frequency. This facilitates a relaxation in the required accuracy of the physical dimensions of the structural components of the generator. It also permits a greater stray in operating parameters of the generator such as ink composition and temperature.

The combined coverage of the top face of cavity 19 by sub-actuators 7 must be sufficiently great that non-resonant operation of the cavity is feasible. If the coverage is not enough, it will not be possible to achieve the same acoustic pressure at all nozzle orifices along the cavity, without operation of the cavity at resonance. Thus, the gaps 41 between lower faces 21 of sub-actuators 7 must be sufficiently narrow (significantly less than a quarter wavelength in the ink), and the sides and ends of cavity 19 must be sufficiently closely approached by sub-actuators 7, ideally overlapped thereby. In this regard, and as explained previously, in the generator described by way of example, gaps 41 are able to be narrow by virtue of each sub-actuator lower face 21 being significantly longer than the diameter of each sub-actuator cylinder 39. Further, by having an ink interface in the gap 41 between sub-actuator feet 31, truly independent sub-actuator vibration is still possible at very small inter-sub-actuator distances. This is to be compared with a more solid interface where truly independent vibration breaks down at appreciably longer inter-sub-actuator distances.

It is advantageous to use a number of independently vibratable sub-actuators rather than a single actuator. When using a single actuator it is difficult to achieve the required precise piston-like motion at all points along the single actuator's length. When using a number of sub-actuators a finer control is possible whereby the vibration of each sub-actuator can be individually adjusted or trimmed so that at all points along the cavity there is the required piston-like motion. In particular, all sub-actuators 7 would be driven with the same frequency, and the phase and amplitude of the driving signal supplied to each sub-actuator would be adjusted, as necessary, so that the sub-actuators all vibrate in phase and with the same amplitude. This compensates for slight differences in the resonant frequencies of the sub-actuators due to manufacturing tolerances.

Figure 6:
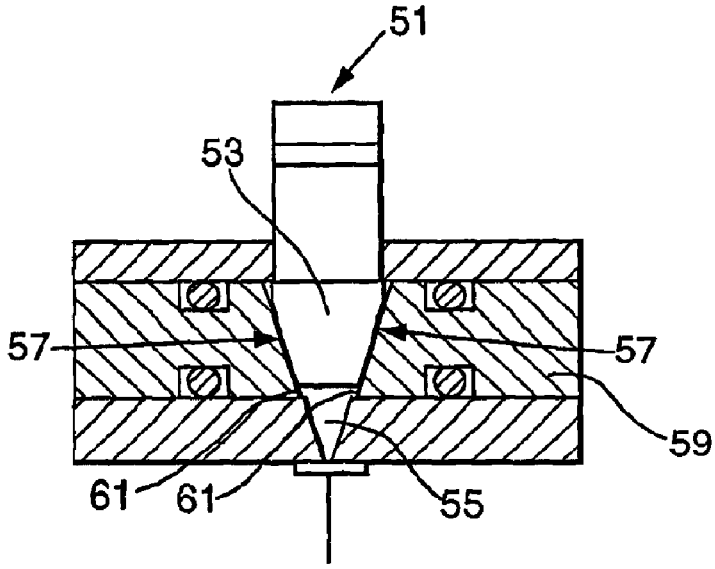
FIG. 6 illustrates incorporation of the first alternative sub-actuator into the droplet generator.
Figure 3:
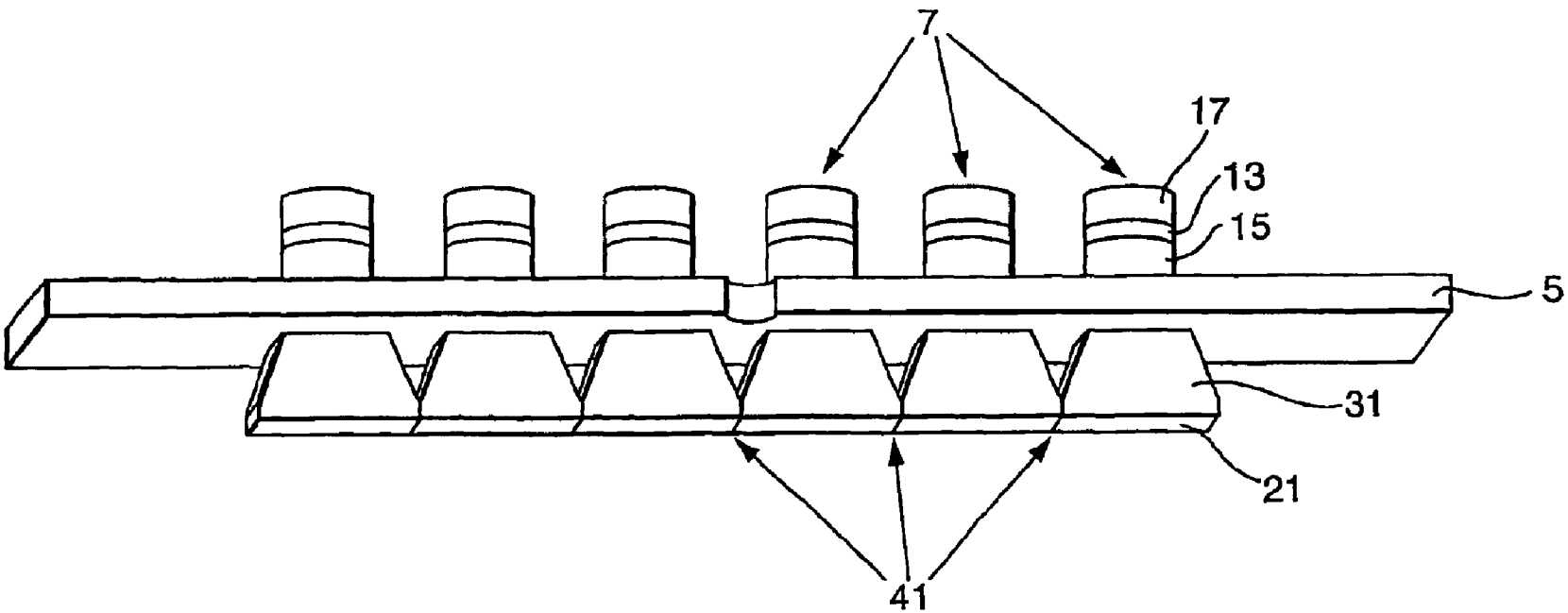
FIG. 3 is a perspective view of a plurality of sub-actuators of the generator secured within a sealing and holding plate of the generator.
Figure 5:
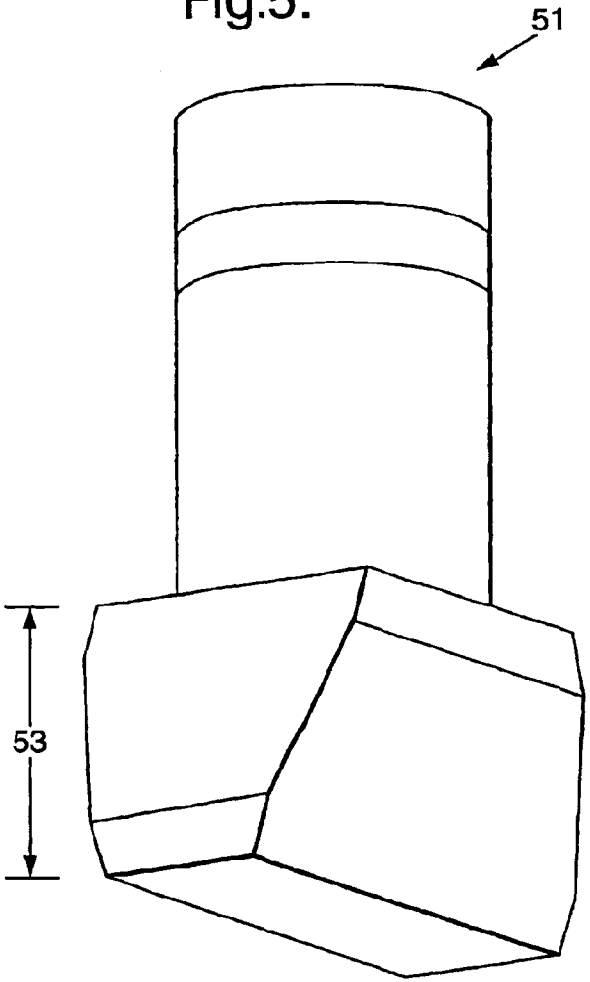
FIG. 5 is a perspective view of a first alternative sub-actuator to the one of FIG. 4.
Figure 4:
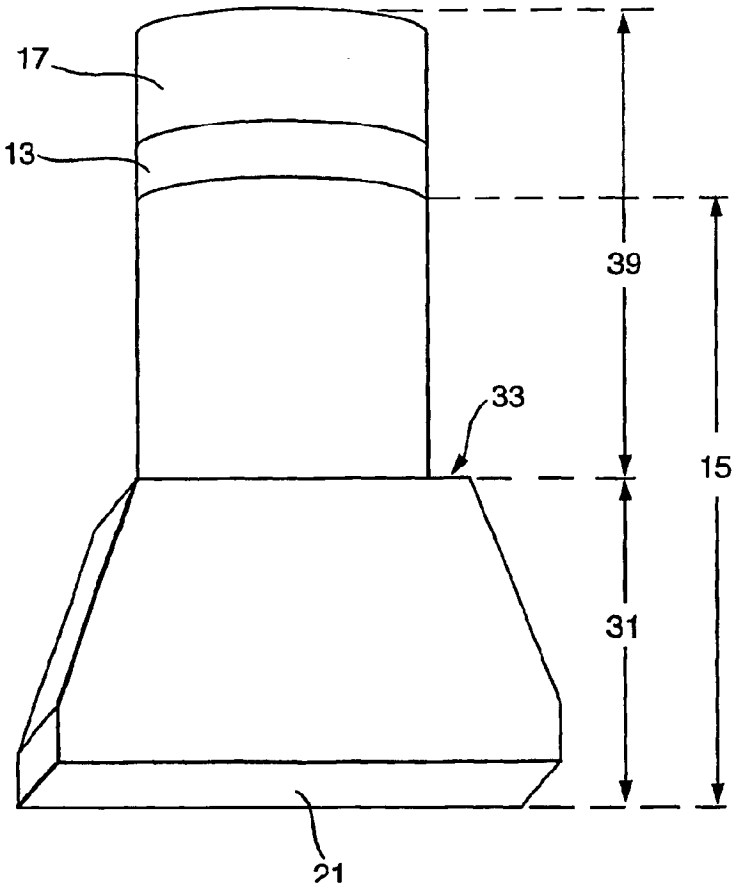
FIG. 4 is a perspective view of one of the sub-actuators.

Referring now also to FIGS. 5 and 6, first alternative sub-actuator 51 has a foot 53 which, as it approaches ink cavity 55, tapers in its dimension across the cavity. This is to be compared to sub-actuator 7 of FIGS. 1 to 4, the foot 31 of which is of constant dimension across the ink cavity. Otherwise, sub-actuator 51 is the same as sub-actuator 7. The inner surfaces 57 of manifold 59 slope correspondingly to the taper of foot 53.

Otherwise, the incorporation of alternative sub-actuator 51 in a droplet generator is the same as for sub-actuator 7. It is to be noted from FIG. 6 that the overlap 61 by sub-actuator 51 of the sides of ink cavity 55 is much reduced as compared to this overlap by sub-actuator 7.

Figure 7:
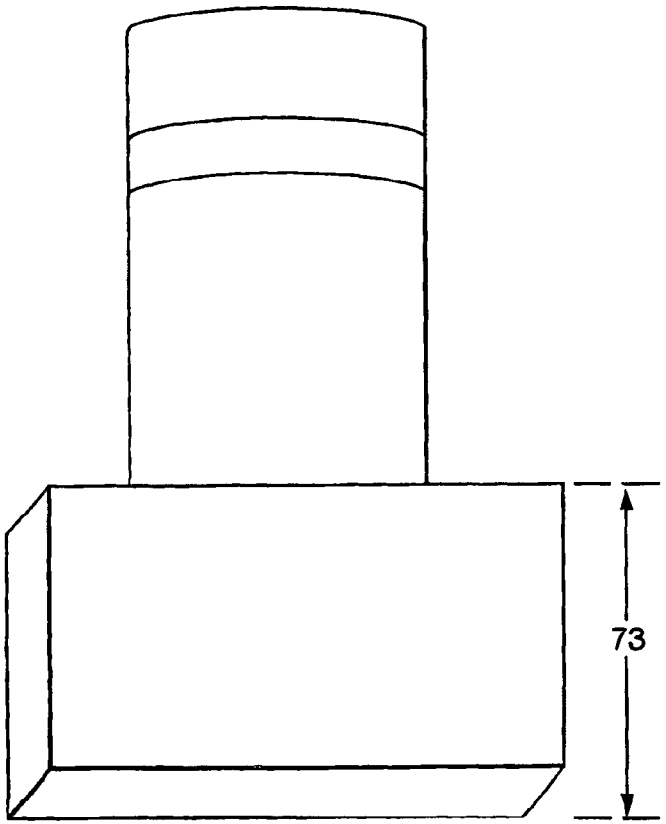

Referring also to FIG. 7, second alternative sub-actuator 71 has a foot 73 which, as it approaches the ink cavity, is of constant dimension both along and across the cavity. Thus, the gap between the feet 73 of sub-actuators 71 is of constant size over the height of the feet.

Figure 8:
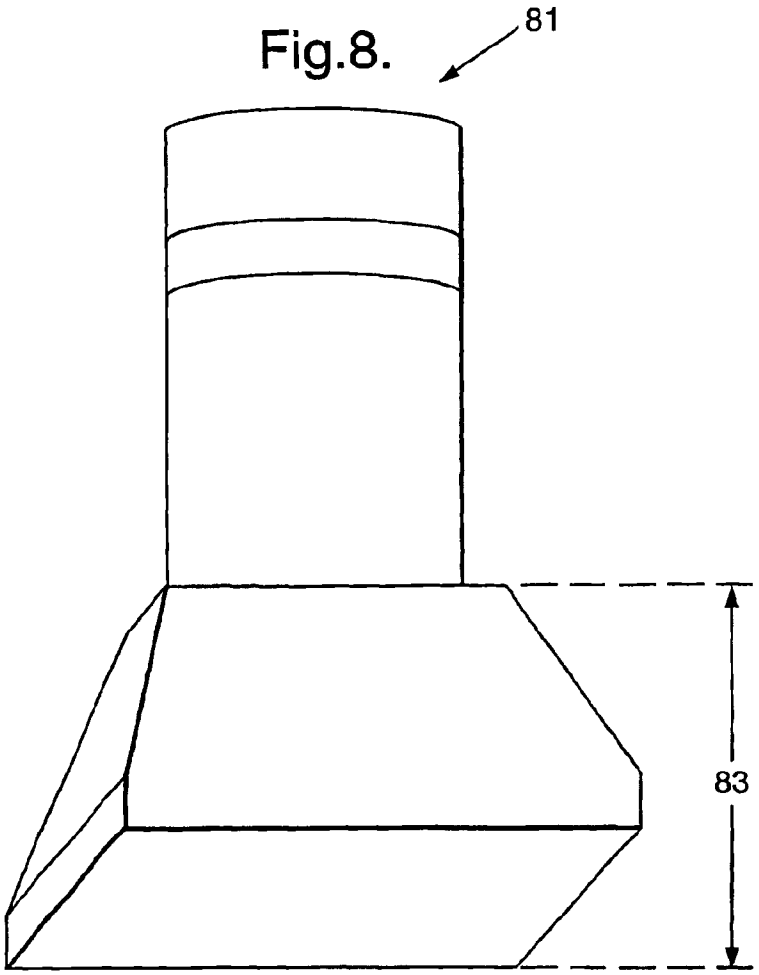
FIGS. 7 and 8 are perspective views of second and third alternative sub-actuators respectively.

Referring also to FIG. 8, third alternative sub-actuator 81 has a foot 83 which, as it approaches the ink cavity, flares outwardly both in its dimension along the cavity and in its dimension across the cavity. When alternative sub-actuator 81 is incorporated in a droplet generator, the inner surfaces of the generator manifold to each side of the cavity, slope correspondingly to the flare of feet 83 across the cavity, i.e. the cavity sides become further apart the lower the position in the cavity.

What is claimed:

1. A droplet generator for a continuous stream ink jet print head, comprising:

a) an elongate cavity for containing ink;

b) nozzle orifices in a wall of said cavity for passing the ink from the cavity to form jets, said nozzle orifices extending along a length of said cavity; and c) actuator means disposed so as to address a face of said cavity opposite said wall to vibrate the ink in the cavity such that each said jet breaks up into ink droplets at substantially a same predetermined distance from said wall, said actuator means comprising a plurality of constituent sub-actuators each capable of independent vibration, each said sub-actuator having an ink addressing face by which it addresses the ink in said cavity, said ink addressing faces being separated by gaps containing ink interfaces, a combined coverage of said face of the cavity by said ink addressing faces of said sub-actuators being such that the break up of the jets is achieved without resonance of said cavity in its dimension from said wall to said cavity face, said sub-actuators being driven in synchronism so that they behave collectively as a single piston-like actuator having an effective ink addressing face comprised as a combination of said ink addressing faces of said sub-actuators.

2. The generator according to claim 1, wherein each said sub-actuator includes a holding-part whereby it is held by said generator, and wherein a dimension of said holding-part in a direction along the cavity is less than a dimension in a same direction of said ink addressing face of the sub-actuator.

3. The generator according to claim 2, further comprising a compliant member into which said sub-actuators are pushfitted by way of their holding-parts, said member forming an ink tight seal around the sub-actuators.

4. The generator according to claim 2, wherein said holding-parts are generally cylindrical in form.

5. The generator according to claim 2, wherein each said sub-actuator comprises said holding-part and a foot-part which includes said ink addressing face, said foot-part flaring outwardly to each side along the length of the cavity as it approaches the cavity.

6. The generator according to claim 5, wherein each foot-part, as it approaches the cavity, is of constant dimension across the cavity.

7. The generator according to claim 5, wherein each foot-part, as it approaches the cavity, generally decreases in its dimension across the cavity.

8. The generator according to claim 5, wherein each foot-part, as it approaches the cavity, generally increases in its dimension across the cavity.

9. The generator according to claim 2, wherein each said sub-actuator comprises said holding-part and a foot-part which includes said ink addressing face, said foot-part being of constant dimension both across and along the cavity as it approaches the cavity.

10. The generator according to claim 2, wherein said ink addressing face is generally rectangular.

11. The generator according to claim 1, wherein said actuator means overlaps ends and sides of said face of the cavity.

* * * * *